US009163425B1

(12) United States Patent
Kubica et al.

(10) Patent No.: US 9,163,425 B1
(45) Date of Patent: Oct. 20, 2015

(54) HUB ASSEMBLY FOR COLLAPSIBLE STRUCTURES

(75) Inventors: Ryan L. Kubica, Flushing, MI (US); Beau E. Crandell, Swartz Creek, MI (US)

(73) Assignee: EVOLVED INGENUITY, LLC, Grand Prairie, TX (US)

( * ) Notice: Subject to any disclaimer, the term of this patent is extended or adjusted under 35 U.S.C. 154(b) by 751 days.

(21) Appl. No.: 13/473,855

(22) Filed: May 17, 2012

Related U.S. Application Data

(60) Provisional application No. 61/486,911, filed on May 17, 2011.

(51) Int. Cl.
*E04H 15/48* (2006.01)

(52) U.S. Cl.
CPC ..... *E04H 15/48* (2013.01)

(58) Field of Classification Search
CPC ..... E04H 15/32; E04H 15/44; E04H 15/48; F16B 7/04; F16B 7/044; F16B 7/0493
USPC ..... 403/64, 169, 170, 171, 176, 178, 403/217–219; 135/135, 120.3, 125, 136, 135/147; 52/81.3, 655.1
See application file for complete search history.

(56) References Cited

U.S. PATENT DOCUMENTS 3,190,208 A * 6/1965 Styne et al. ..... 454/296
3,810,482 A 5/1974 Beavers
4,034,534 A * 7/1977 Taylor ..... 52/668
4,364,215 A * 12/1982 Gailey et al. ..... 52/506.08
4,545,165 A * 10/1985 Carey et al. ..... 52/506.07
4,640,077 A * 2/1987 Hall ..... 52/665
4,757,663 A * 7/1988 Kuhr ..... 52/481.1
4,838,003 A * 6/1989 Zeigler ..... 52/646
4,971,090 A * 11/1990 Uhl ..... 135/98
4,995,212 A 2/1991 Morgan et al.
5,943,837 A 8/1999 Esser et al.
6,089,247 A * 7/2000 Price ..... 135/145
6,295,667 B1 * 10/2001 Cheng ..... 5/99.1
6,553,698 B1 4/2003 Kemeny
6,591,571 B2 7/2003 Fritsche et al.
7,481,235 B2 1/2009 Prusmack
7,735,504 B2 * 6/2010 Carter ..... 135/145
8,069,872 B2 * 12/2011 Bae ..... 135/147

* cited by examiner

*Primary Examiner* — Daniel Wiley

(74) *Attorney, Agent, or Firm* — Geoffrey A. Mantooth; Brian K. Yost

(57) ABSTRACT

A hub assembly for collapsible structures includes a first hub portion and a second hub portion. The first hub portion has a substantially U-shaped configuration and defines at least a first opening. The second hub portion has a substantially U-shaped configuration and defines at least a first pair of aligned openings. The first hub portion and the second hub portion are connected in a crossing-configuration, such that at least part of the second hub portion is received within the first pair of aligned openings of the first hub portion and at least part of the second hub portion is received within the first opening of the first hub portion.

19 Claims, 8 Drawing Sheets

HUB ASSEMBLY FOR COLLAPSIBLE STRUCTURES

CROSS-REFERENCE TO RELATED APPLICATIONS

This application claims the benefit of U.S. Provisional Application Ser. No. 61/486,911, filed on May 17, 2011, which is incorporated herein in its entirety by reference.

TECHNICAL FIELD

The disclosure relates to the field of collapsible structures, and more particularly, to a hub assembly for collapsible structures.

BACKGROUND OF THE INVENTION

Collapsible structures are known in which a flexible covering is supported by a framework of flexible poles that are interconnected by hubs. For example, a wall of the flexible covering may include pockets at its corners in which outer ends of each of the fabric poles are disposed. The inner ends of the flexible poles are pivotally connected to a hub. The hub allows movement of the flexible poles between collapsed and deployed positions. In the collapsed position, the outer ends of the flexible poles could be adjacent to one another, and the wall of the flexible cover is not held taut. In the deployed position, the flexible poles establish a somewhat planar configuration for the wall of the flexible cover and are held in an over-center condition with respect to the hub by tension that is induced within the poles by the wall of the flexible cover. A structure of this general type is shown in U.S. Pat. No. 3,810,482.

SUMMARY

Hub assemblies for collapsible structures are disclosed herein.

One hub assembly includes a first hub portion and a second hub portion. The first hub portion has a substantially U-shaped configuration that is defined by a first base wall and a first pair of opposed side walls that extend outward from the first base wall. The first hub portion also has a first end and a second end. At least a first opening is defined by the first hub portion and is formed continuously through the first base wall and the first pair of opposed side walls of the first hub portion. The second hub portion has a substantially U-shaped configuration that is defined by a second base wall and a second pair of opposed side walls that extend outward from the second base wall. The second hub portion has a first end and a second end, wherein at least a first pair of aligned openings is defined by the second hub portion, and the openings of the first pair of aligned openings are formed through the second pair of opposed side walls of the second hub portion. The first hub portion and the second hub portion are connected in a crossing-configuration, such that at least part of the second hub portion is received within the first pair of aligned openings of the first hub portion and at least part of the second hub portion is received within the first opening of the first hub portion.

Another hub assembly taught includes a first hub portion and a second hub portion. The first hub portion has a substantially U-shaped configuration that is defined by a first base wall and a first pair of opposed side walls that extend outward from the first base wall. The first hub portion also has a first end and a second end. At least a first opening is defined by the first hub portion and is formed continuously through the first base wall and the first pair of opposed side walls of the first hub portion. The second hub portion has a substantially U-shaped configuration that is defined by a second base wall and a second pair of opposed side walls that extend outward from the second base wall. The second hub portion also has a first end and a second end, wherein at least a first pair of aligned openings is defined by the second hub portion, and the openings of the first pair of aligned openings are formed through the second pair of opposed side walls of the second hub portion. The first hub portion and the second hub portion are connected in a crossing-configuration, such that at least part of the second hub portion is received within the first pair of aligned openings of the first hub portion and at least part of the second hub portion is received within the first opening of the first hub portion. A first pivot joint is located at the first end of the first hub portion. The first pivot joint includes a first pin that is supported between the first pair of opposed side walls of the first hub portion and a first ferrule that is pivotally connected to the first pin. A second pivot joint is located at the second end of the first hub portion. The second pivot joint includes a second pin that is supported between the first pair of opposed side walls of the first hub portion and a second ferrule that is pivotally connected to the second pin. A third pivot joint is located at the first end of the second hub portion. The third pivot joint includes a third pin that is supported between the second pair of opposed side walls of the second hub portion and a third ferrule that is pivotally connected to the third pin. The fourth pivot joint is located at the second end of the second hub portion. The fourth pivot joint includes a fourth pin that supported between the second pair of opposed side walls of the second hub portion and a fourth ferrule that is pivotally connected to the fourth pin.

Another hub assembly includes a first hub portion having a substantially U-shaped configuration, and a second hub portion having a substantially U-shaped configuration. At least one opening is formed in the second hub portion. At least part of the first hub portion is received within the opening of the second hub portion to connect the first hub portion to the second hub portion in a crossing configuration. A first flexible pole pivotally connected to the first hub portion. A second flexible pole pivotally connected to the first hub portion. A third flexible pole pivotally connected to the second hub portion. A fourth flexible pole pivotally connected to the second hub portion.

BRIEF DESCRIPTION OF THE DRAWINGS

The various features, advantages and other uses of the present apparatus will become more apparent by referring to the following detailed description and drawing in which.

DETAILED DESCRIPTION

Figure 1:
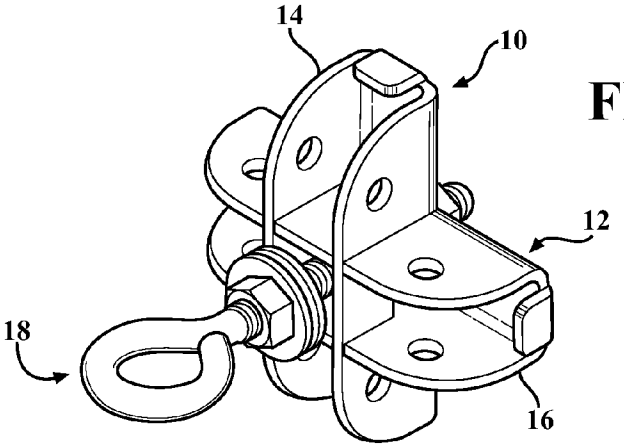
FIG. 1 is a perspective view showing a hub assembly.

FIG. 1 shows a hub assembly 10. The hub assembly 10 is formed from two interlocking portions, namely a first hub portion 14 and a second hub portion 16.

Figure 2:
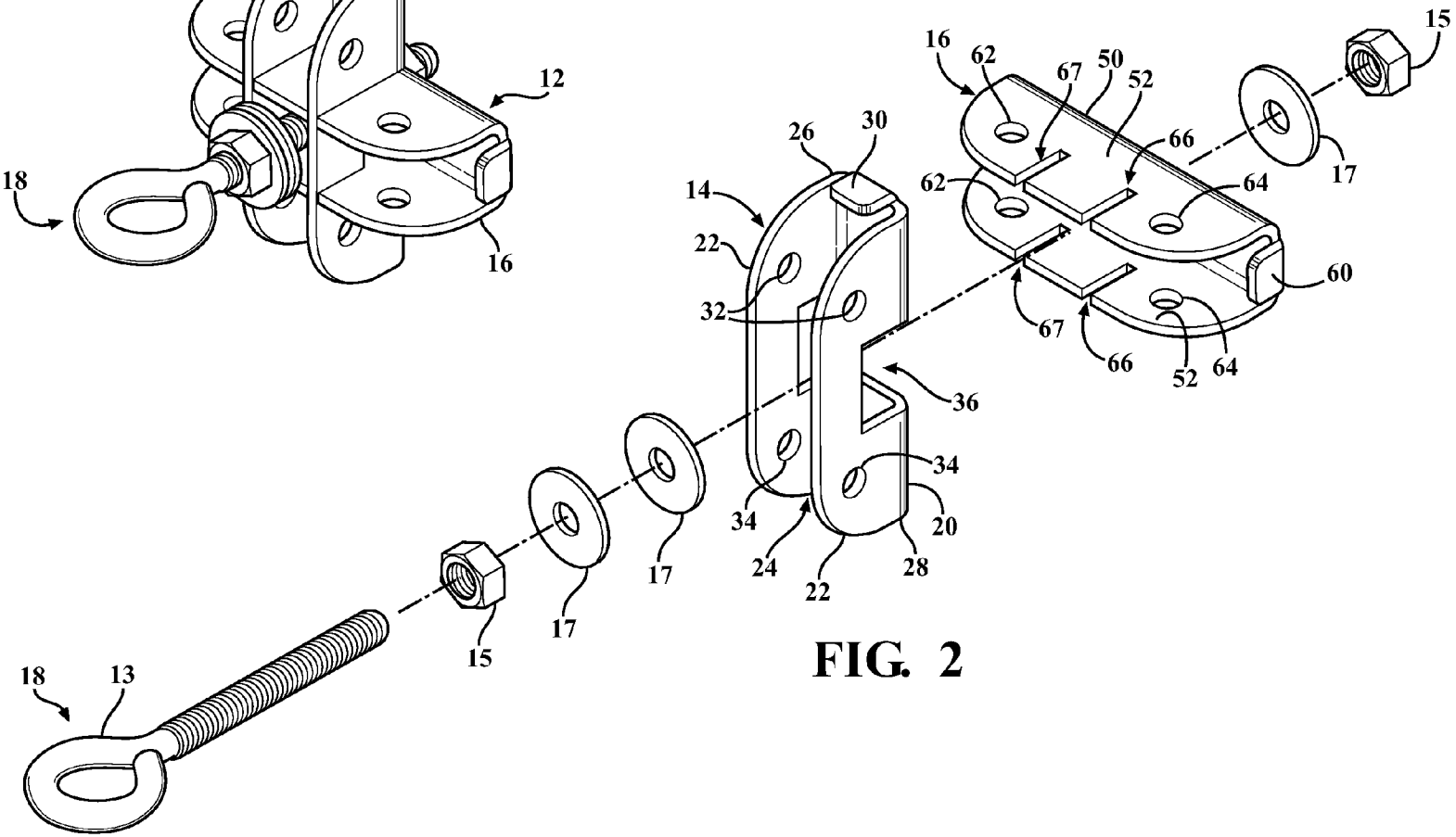
FIG. 2 is an exploded view of the hub assembly of FIG. 1.

The hub assembly 10 could include a fastening structure 18. The fastening structure 18 could, but need not, secure the first hub portion 14 with respect to the second hub portion 16, as will be described in detail herein. As shown in FIG. 2, the fastening structure 18 could include an eyebolt 13 and fasteners, such as nuts 15 and washers 17 that secure the eyebolt 13 with respect to the first hub portion 14 and the second hub portion 16.

The first hub portion 14 is a generally U-shaped structure having a base wall 20 and a pair of opposed side walls 22 that extend outward from opposite sides of the base wall 20, such that the opposed side walls 22 are spaced apart from one another by an internal channel 24 of the first hub portion 14. The opposed side walls 22 each extend substantially perpendicular with respect to the base wall 20 and are substantially parallel with respect to one another. The base wall 20 and each of the opposed side walls 22 are generally planar, thin-walled structures. As will be explained herein, the first hub portion may be fabricated from a one-piece stamping, such that the base wall 20 and the opposed side walls 22 are formed integrally with respect to one another as a one-piece, unitary structure.

The internal channel 24 of the first hub portion 14 extends from a first end 26 of the first hub portion 14 to a second end 28 of the first hub portion 14. The upstanding tabs 30 are positioned at the first end 26 and the second end 28 of the first hub portion 14 and extend outward from and substantially perpendicular to the base wall 20. The upstanding tabs 30 and the opposed side walls 22 all extend in a common direction with respect to the base wall 20.

A first pair of aligned apertures 32 is formed through the opposed side walls 22 of the first hub portion 14. A second pair of aligned apertures 34 is formed through the opposed side walls 22 of the first hub portion 14.

Figure 3A:
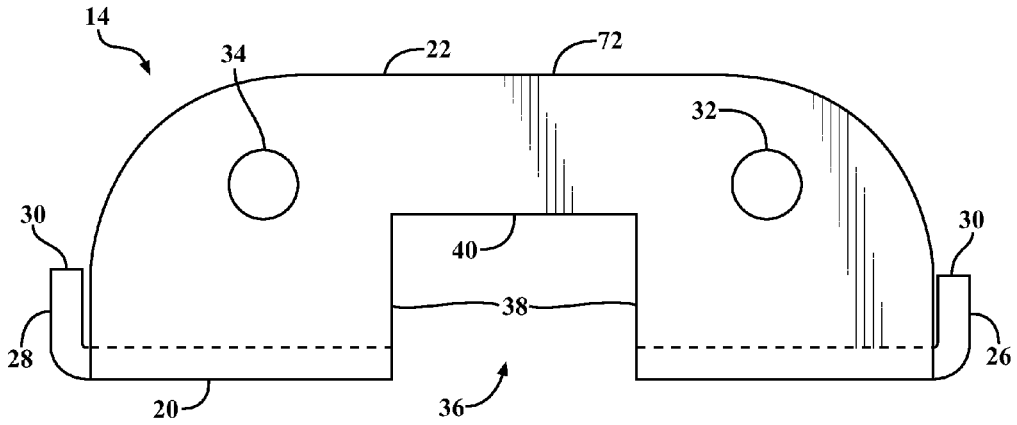
FIG. 3A is a side view of a first hub portion of the hub assembly of FIG. 1.

In order to allow connection of the first hub portion 14 to the second hub portion 16, an opening 36 is formed continuously through the base wall 20 and the opposed side walls 22 of the first hub portion 14. The opening 36 has a width that is substantially equivalent to the width of the second hub portion 16, such that at least part of the second hub portion 16 can be received within the opening 36 of the first hub portion 14 in a crossing configuration. As best seen in FIG. 3A, the opening 36 defines spaced apart surfaces 38 that extend substantially perpendicular to the base wall 20 of the first hub portion 14. The spaced apart surfaces 38 are spaced from one another by a distance that is substantially equal to the width of the second hub portion 16. The opening 36 is further defined by longitudinally-extending surfaces 40 that are defined on each of the opposed side walls 22.

Figure 3B:
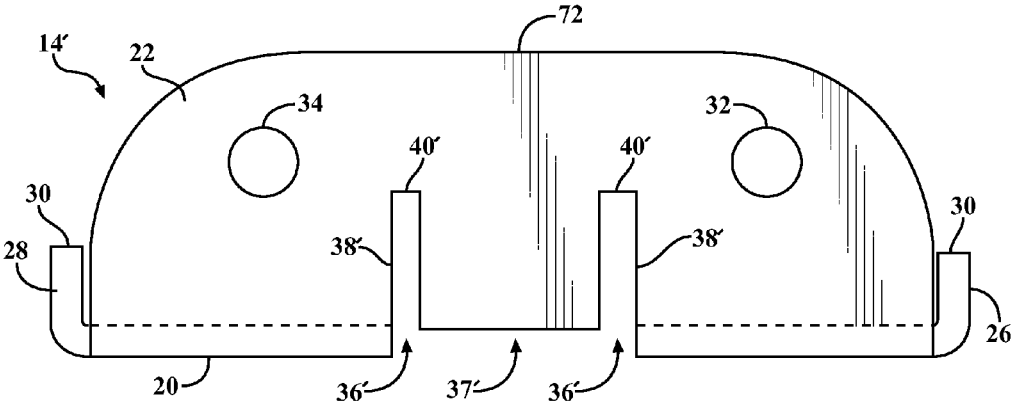
FIG. 3B is an alternative first hub portion.

The opening 36 is not the only means by which connection could be made to the second hub portion 16. Rather, as shown in FIG. 3B, an alternative first hub portion 14' includes a pair of spaced apart openings 36 in the form of slots, each defining one or more internal surfaces 38' that are spaced apart by substantially the width of the second hub portion 16. The pair of spaced apart openings 36' are further defined by longitudinally-extending surfaces 40'. Similar to the opening 36, the pair of spaced apart openings 36' each extend continuously through the base wall 20 and each of the opposed side walls 22. At the base wall 20, the pair of spaced apart openings 36' combine into a single opening 37' that is defined through the base wall 20 and is substantially the same width as the second hub portion 16.

In both of the configurations shown in FIG. 3A and the configuration shown in FIG. 3B, the first hub portion 14 and the alternative first hub portion 14' both define openings that are adapted to receive at least a portion of the second hub portion 16 such that the second hub portion 16 extends through the internal channel 24 of the first hub portion 14, the first hub portion 14 extends substantially perpendicular to the second hub portion 16 and the opening or openings through which the second hub portion 16 extends is formed at least partially through the base wall 20.

The second hub portion 16 is a generally U-shaped structure having a base wall 50 and a pair of opposed side walls 52 that extend outward from opposite sides of the base wall 50, such that the opposed side walls 52 are spaced apart from one another by an internal channel 54 of the second hub portion 16. The opposed side walls 52 each extend substantially perpendicular with respect to the base wall 50 and are substantially parallel with respect to one another. The base wall 50 and each of the opposed side walls 52 are generally planar, thin-walled structures. As will be explained herein, the first hub portion may be fabricated from a one-piece stamping, such that the base wall 50 and the opposed side walls 52 are formed integrally with respect to one another as a one-piece, unitary structure.

The internal channel 54 of the second hub portion 16 extends from a first end 56 of the second hub portion 16 to a second end 58 of the second hub portion 16. Upstanding tabs 60 are positioned at the first end 56 and the second end 58 of the second hub portion 16 and extend outward from and substantially perpendicular to the base wall 50. The upstanding tabs 60 and the opposed side walls 52 all extend in a common direction with respect to the base wall 50.

A first pair of aligned apertures 62 is formed through the opposed side walls 52 of the second hub portion 16. A second pair of aligned apertures 64 is formed through the opposed side walls 52 of the second hub portion 16.

Figure 4A:
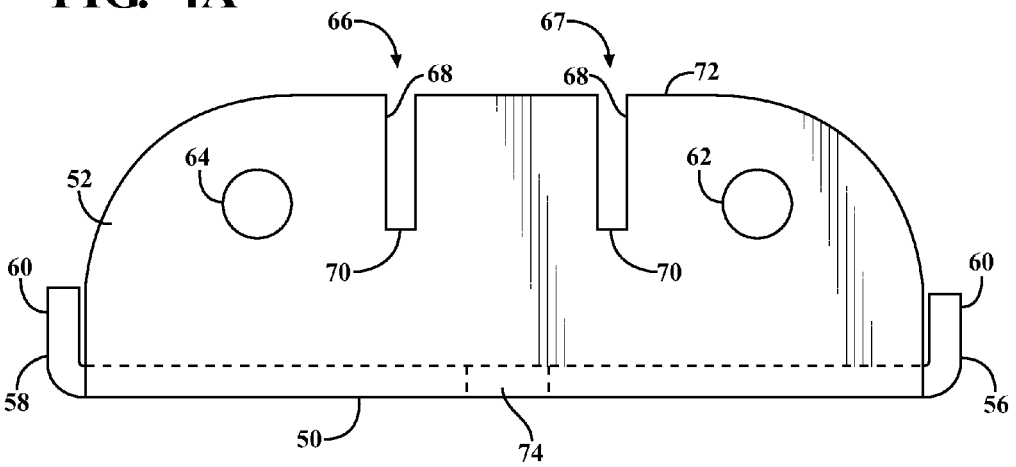
FIG. 4A is a side view of a second hub portion of the hub assembly of FIG. 1.

In order to allow connection of the second hub portion 16 to the first hub portion 14, a first pair of aligned openings 66 and a second pair of aligned openings 67 are formed through the opposed side walls 22 of the first hub portion 14. The openings 66, 67 may be in the form of slots. Each opening of the first pair of aligned openings 66 and the second pair of aligned openings 67 has a width that is substantially equivalent to the width of one of the opposed side walls 22 of the first hub portion 14, such that at least part of the first hub portion 14 can be received within each of the openings 66, 67 of the second hub portion 16 in a crossing configuration. As best seen in FIG. 4A, the openings 66, 67 define spaced apart surfaces 68 that extend substantially perpendicular to the base wall 50 of the second hub portion 16. The spaced apart surfaces 68 are spaced from one another by a distance that is substantially equal to the width of the second hub portion 16, such that each of the opposed side walls 22 of the first hub portion 14 is receivable within a respective one of the openings 66, 67. The openings 66, 67 are further defined by longitudinally-extending surfaces 70 that are defined on each of the opposed side walls 52.

Figure 4B:
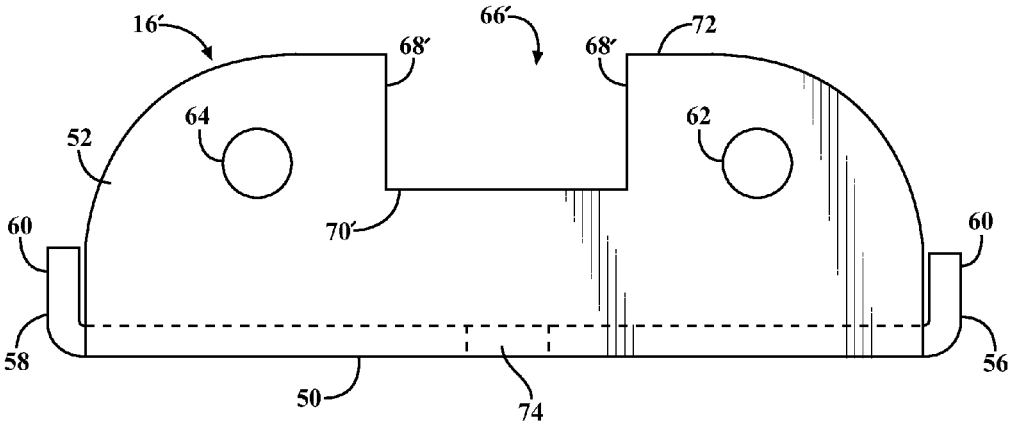
FIG. 4B is a side view of an alternative second hub portion.

The openings 66, 67 are not the only means by which connection could be made to the first hub portion 14. Rather, as shown in FIG. 4B, an alternative second hub portion 16' includes a single pair of aligned openings 66', each defining one or more internal surfaces 38' that are spaced apart by substantially the width of the first hub portion 14. The openings 66' are further defined by longitudinally-extending surfaces 40'. Similar to the openings 66, 67, the openings 66' each extend through each of the opposed side walls 52.

In both the embodiment shown in FIG. 4A and the embodiment shown in FIG. 4B, one or more openings, such as the first and second pairs of aligned openings 66, 67 or the single pair of aligned openings 66' are formed through the second hub portion 16 or the alternative second hub portion 16'. Either configuration may be utilized, and other configurations could be utilized as well, as long as at least a portion of the first hub portion 14 is receivable within the openings, such that the first hub portion 14 is at least partially disposed within the internal channel 54 of the second hub portion 16 or the alternative second hub portion 16'. In such a configuration, the second hub portion 16 extends substantially transverse or perpendicular to the first hub portion 14, the opposed side walls 52 of the second hub portion 16 engage the opposed side walls 22 of the first hub portion 14, and the base wall 20 of the first hub portion 14 is substantially coplanar to the base wall 50 of the second hub portion 16.

Fabrication and assembly of the hub assembly 10 will now be described.

Figure 5A:
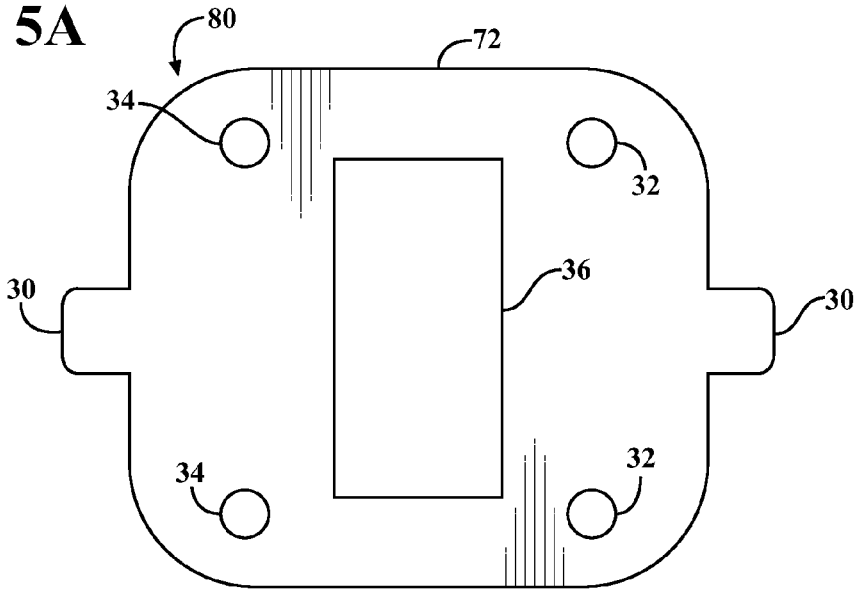
FIG. 5A is a top view of a first blank from which the first hub portion of FIG. 3A may be formed.
Figure 5B:
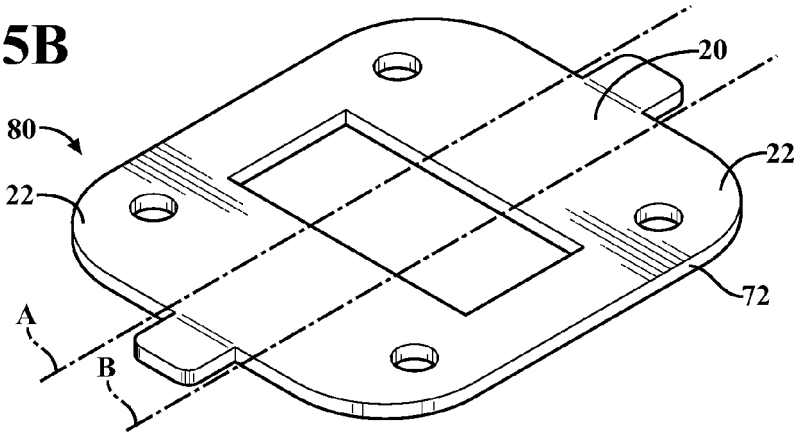
FIG. 5B is a perspective view of the first blank of FIG. 5A.
Figure 5C:
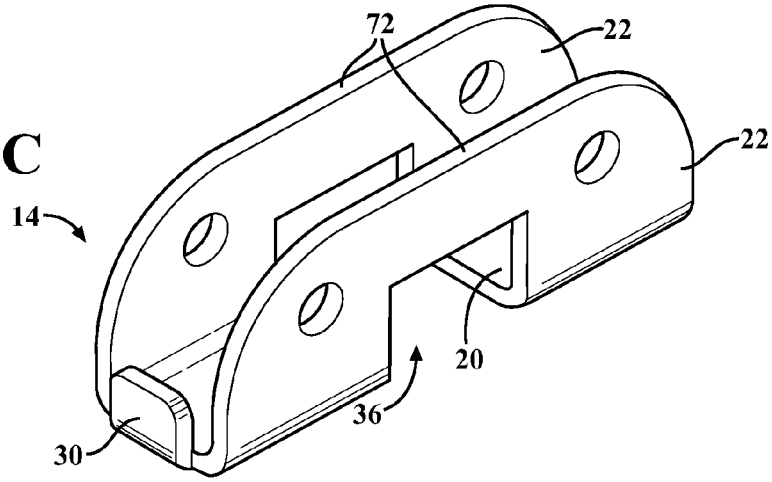
FIG. 5C is a perspective view showing the first hub portion of FIG. 3A.

FIGS. 5A-5C depict a method of forming the first hub portion 14. Initially, a first hub portion blank 80 is provided. The first hub portion blank 80 is a substantially planar element, which is typically fabricated from metal, such as a relatively thin steel plate. The first hub portion blank 80 is punched, stamped, or otherwise machined to have a desired shape that includes the peripheral edge 72, the pairs of aligned apertures 32, 34, the opening 36, and the upstanding tabs 30 (FIG. 5A). In order to define the side walls 22 and the base wall 20, the first hub portion blank 80 is divided by a first bend line A and a second bend line B. The base wall 20 lies between the first bend line A and the second bend line B, and each of the opposed side walls 22 lies outward from one of the first bend line A or the second bend line B and is situated between the respective bend line and the peripheral edge 72 of the first hub portion blank 80. The opening 36 is positioned on the first hub portion blank 80 such that it extends across both the first bend line A and the second bend line B. The first hub portion blank 80 is bent using conventional technique at the first bend line A and the second bend line B to define the opposed side walls 22 (FIG. 5C). The first hub portion blank 80 is also bent to define the upstanding tabs 30 in their outwardly-extending relationship with respect to the base wall 20.

Figure 6A:
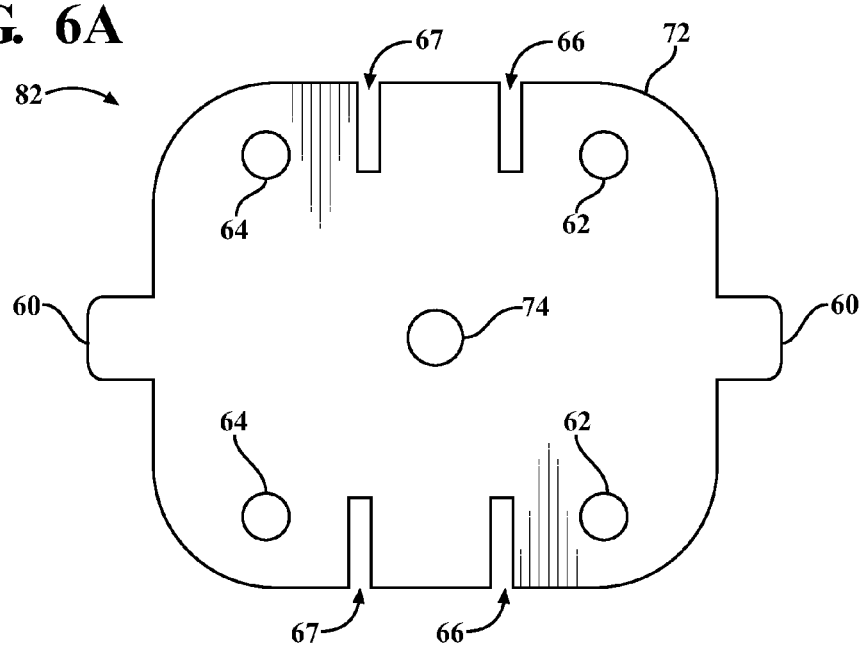
FIG. 6A is a top view of a second blank from which the second hub portion of FIG. 4A may be formed.
Figure 6B:
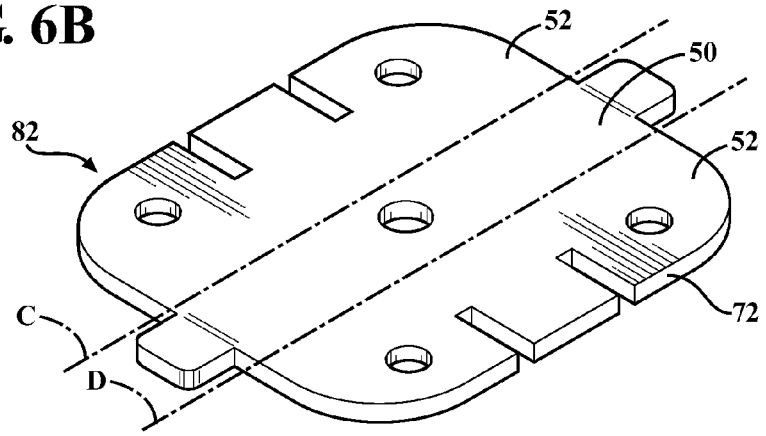
FIG. 6B is a perspective view of the second blank of FIG. 6A.
Figure 6C:
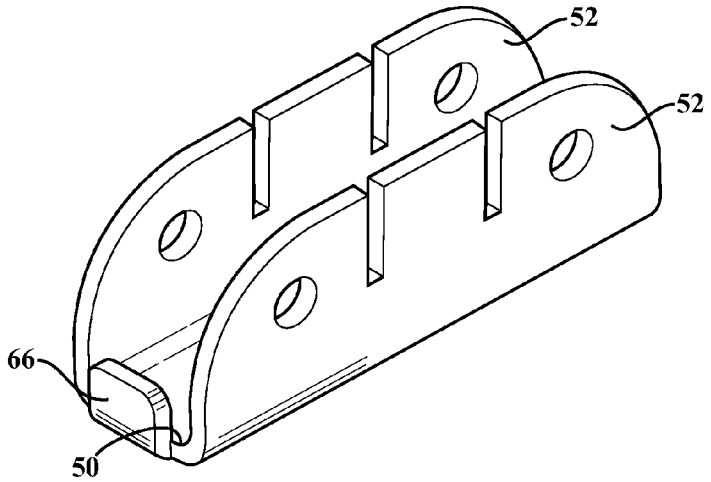
FIG. 6C is a perspective view of the second hub portion of FIG. 4A.

FIGS. 6A-6C show a method of fabricating the second hub portion 16. A second hub portion blank 82 is formed by conventional machining processes such as punching, stamping, or milling to produce a desired shape having a peripheral edge 72, openings 66 extending inward from the peripheral edge 72, outward projections that will later define the upstanding tabs 60, a central aperture 74 in which the eyebolt 13 will later be receivable, and the pairs of aligned apertures 62, 64 (FIG. 6A). The second hub portion blank 82 is divided into three areas by a third bend line C and a fourth bend line D. The area that will later define the base wall 50 is disposed between the third bend line C and the fourth bend line D. The areas that will define each of the side walls 52 are disposed outward of one of the third bend line C or the fourth bend line D and are situated between the respective bend line and the peripheral edge 72 of the second hub portion blank 82. The second hub portion blank 82 is then bent at the third bend line C and the fourth bend line D by conventional methods to define the base wall 50 and each of the opposed side walls 52, as well as the upstanding tabs 60 (FIG. 6C).

Figures 7A, 7B, 7C, 7D:
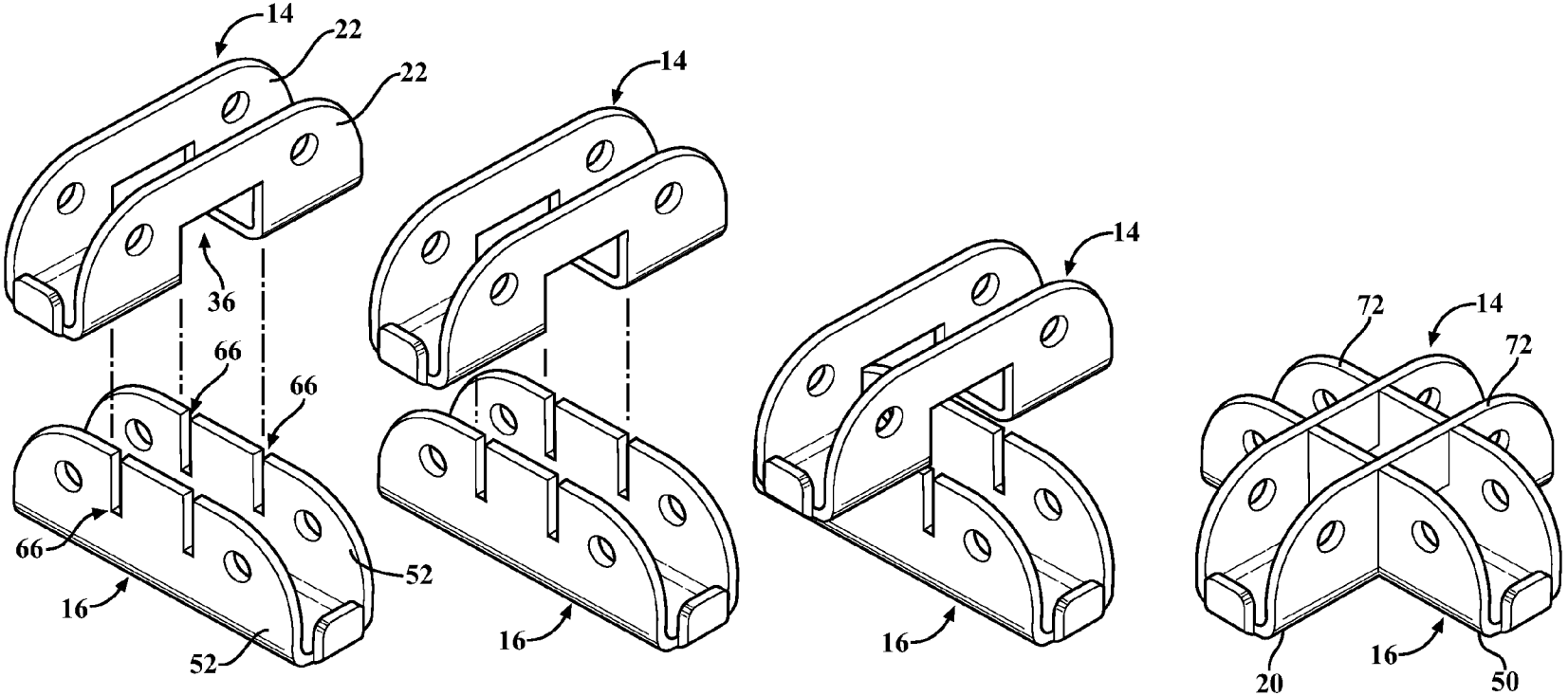
FIGS. 7A-7D show assembly of the first hub portion with respect to the second hub portion to define a hub body of the hub assembly of FIG. 1.

Once the first hub portion 14 and the second hub portion 16 have been fabricated by means such as punching and bending, as illustrated in FIGS. 5A-5C and FIGS. 6A-6C, the first hub portion 14 and the second hub portion 16 are joined together, as illustrated in FIGS. 7A-7D. In particular, as shown in FIG. 7A, the first hub portion 14 and the second hub portion 16 are initially aligned with respect to one another in a crossing configuration such that the opening 36 of the first hub portion 14 is aligned with the openings 66 of the second hub portion 16. The first hub portion 14 and the second hub portion 16 are then joined together by disposition of portions of the side walls 22 of the first hub portion 14 in the openings 66 of the second hub portion 16 and by disposition of portions of the side walls 52 of the second hub portion 16 within the opening 36 of the first hub portion 14. When assembly is completed, the base walls 20, 50 of the first and second hub portions 14, 16 are substantially coplanar with respect to one another, and peripheral edges 72 of the first hub portion 14 and the second hub portion 16 are brought into a substantially coplanar relationship with respect to one another opposite the base walls 20, 50, as shown in FIG. 7D.

Figure 8:
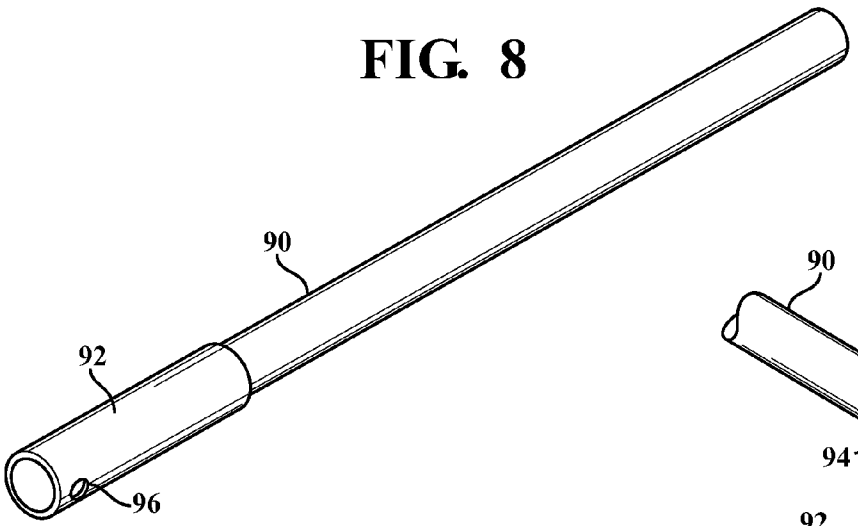
FIG. 8 shows a flexible pole having a ferrule connected thereto.
Figure 9:
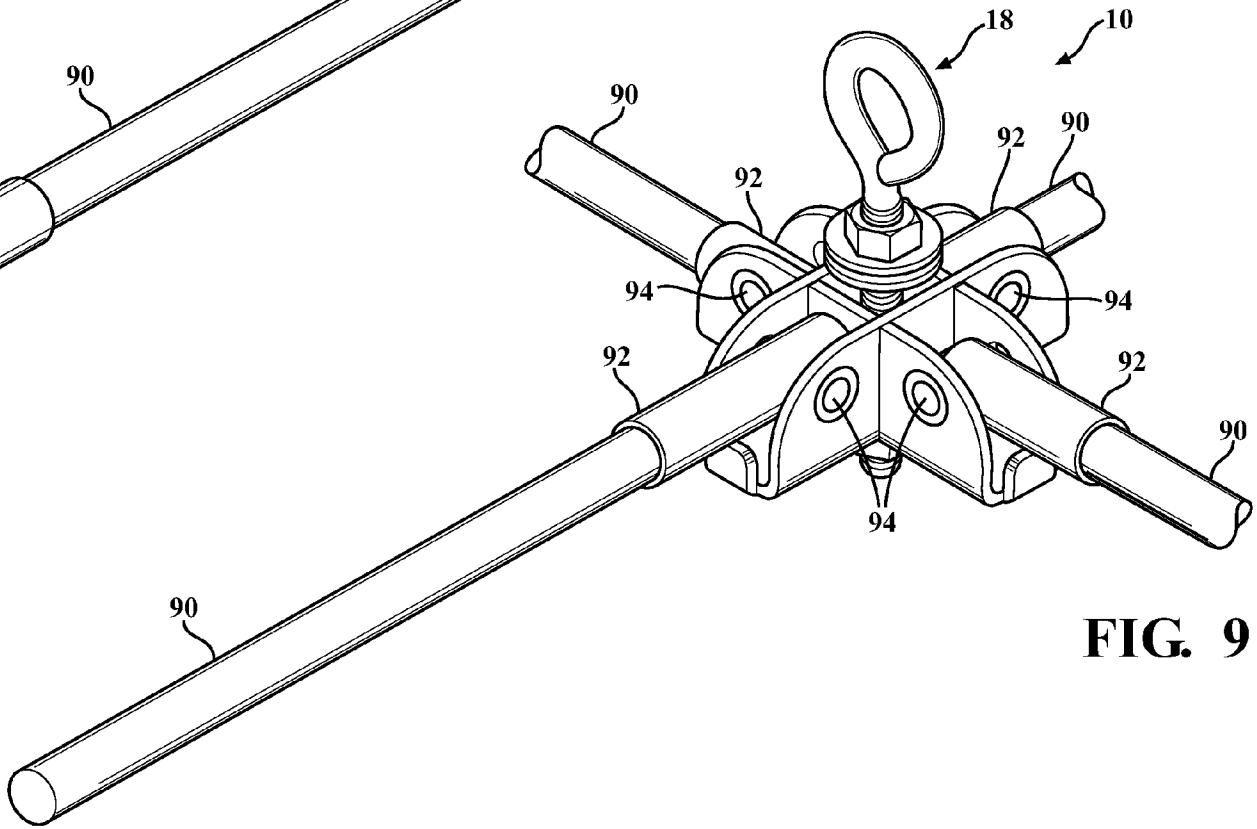
FIG. 9 shows the hub assembly of FIG. 1 including the ferrule and flexible pole of FIG. 8.

As shown in FIGS. 8-9, the hub assembly 10 includes four pivot joints at which flexible poles 90 are pivotally attachable to the hub assembly 10. The pivot joints are defined by pivoting elements such as ferrules 92 that are each pivotally mounted, such as on a respective riveted pin 94 that extends through one of the pairs of aligned apertures 32, 34, 62, 64, and thus between a respective pair of the opposed side walls 22, 52 of the first hub portion 14 or the second hub portion 16. The flexible pole 90 may be any suitable pole, such as a fiberglass pole. The ferrule 92 is a hollow, substantially tubular member that may be fabricated from materials such as steel. A hole 96 is formed to receive the pin 94. The flexible pole 90 is received within the ferrule 92 and may be held by a friction fit or by adhesives or by other suitable means. In order to limit the range of pivotal motion of the ferrules 92 and the flexible poles 90 at the pivot joints, the ferrules 92 and/or the flexible poles 90 are engageable with the upstanding tabs 30, 60 of the first hub portion 14 and the second hub portion 16.

Figure 10:
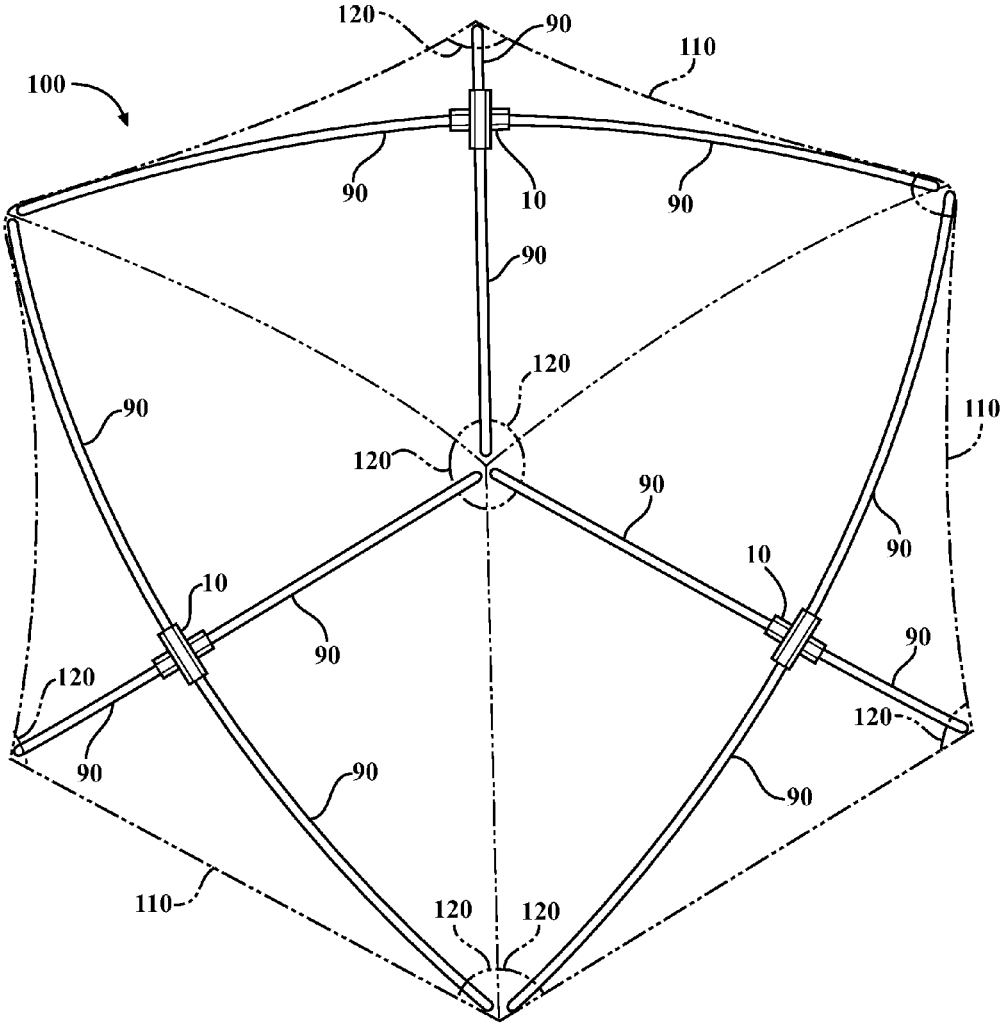
FIG. 10 is a perspective view showing a collapsible structure that includes the hub assembly of FIG. 1.

FIG. 10 is a perspective view showing a collapsible structure 100 that includes the hub assembly 10. The collapsible structure 100 includes a plurality of fabric walls 110. The fabric walls 110 can be made of any material that can be held under tension by the hub assemblies 10 and flexible poles 90, such as nylon. Each of the fabric walls is supported by one of the hub assemblies 10, including four of the flexible poles 90. The hub assemblies 10 are each positioned near the center of a respective one of the fabric walls, and the flexible poles 90 extend outward from each hub assembly 10, with their free ends disposed within sleeves or pockets 120 that are connected to the fabric walls 110, to apply tension to the fabric walls 110. The flexible poles 90 are held in an over-center condition while the collapsible structure is erected. The collapsible structure 100 can be collapsed by pivoting the flexible poles 90 with respect to the hub assembly 10 to which they are connected.

It should be understood that the fastening structure 18 is optional. The first hub portion 14 and the second hub portion 16 may be combined to define the hub assembly 10 without use of the fastening structure 18. The first hub portion 14 and the second hub portion 16 could be held together by friction fit or could be held together by means such as adhesives or welding. The fastening structure 18 could, however, serve to hold the first hub portion 14 and the second hub portion 16 together. However, it is contemplated that the fastening structure 18 could merely serve to attach things to the hub assembly 10, such as lanyards that allow a user to pull the hub to collapse the wall of a structure in which the hub assembly 10 is incorporated.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A hub assembly for collapsible structures, comprising:

a first hub portion having a substantially U-shaped configuration that is defined by a first base wall and a first pair of opposed side walls that extend outward from the first base wall, the first hub portion having a first end and a second end, wherein at least a first opening is defined by the first hub portion and is formed continuously through the first base wall and the first pair of opposed side walls of the first hub portion;

a second hub portion having a substantially U-shaped configuration that is defined by a second base wall and a second pair of opposed side walls that extend outward from the second base wall, the second hub portion having a first end and a second end, wherein at least a first pair of aligned openings is defined by the second hub portion and the openings of the first pair of aligned openings are formed through the second pair of opposed side walls of the second hub portion, wherein the first hub portion and the second hub portion are connected in a crossing-configuration, such that at least part of the first hub portion is received within the first pair of aligned openings of the second hub portion and at least part of the second hub portion is received within the first opening of the first hub portion:

a first pivot joint located at the first end of the first hub portion;

a second pivot joint located at the second end of the first hub portion;

a third pivot joint located at the first end of the second hub portion;

a fourth pivot joint located at the second end of the second hub portion;

wherein the first pivot joint, the second pivot joint, the third pivot joint and the fourth pivot joint each include a pin and a respective pivoting element that is supported by the pin.

2. The hub assembly of claim 1, wherein the first pivot joint and the second pivot joint are each supported between the first pair of opposed side walls of the first hub portion, and the second pivot joint and the third pivot joint are each supported between the second pair of opposed side walls of the second hub portion.

3. The hub assembly of claim 1, wherein the side walls of the first pair of opposed side walls are spaced apart from one another by a first internal channel, the side walls of the second pair of opposed side walls are spaced apart from one another by a second internal channel, the first pivot joint and the second pivot joint are each located at least partially within the first internal channel of the first hub portion, and the third pivot joint and the fourth pivot joint are each located at least partially within the second internal channel of the second hub portion.

4. The hub assembly of claim 1, wherein each pivoting element is a ferrule that is connectable to a flexible pole.

5. The hub assembly of claim 1, wherein the first hub portion includes a first upstanding tab that extends outward from the first base wall at the first end thereof, the first hub portion includes a second upstanding tab that extends outward from the first base wall at the second end thereof, the second hub portion includes a third upstanding tab that extends outward from the second base wall at the first end thereof, and the second hub portion includes a fourth upstanding tab that extends outward from the second base wall at the second end thereof, wherein each upstanding tab is engageable with a respective one of the pivoting elements to limit a range of pivotal motion thereof.

6. The hub assembly of claim 1, further comprising:

a first flexible pole connected to the first pivot joint for pivotal motion of the first flexible pole with respect to the first hub portion;

a second flexible pole connected to the second pivot joint for pivotal motion of the second flexible pole with respect to the first hub portion;

a third flexible pole connected to the third pivot joint for pivotal motion of the third flexible pole with respect to the second hub portion; and a fourth flexible pole connected to the fourth pivot joint for pivotal motion of the fourth flexible pole with respect to the second hub portion.

7. The hub assembly of claim 6, wherein the first hub portion includes a first upstanding tab that extends outward from the first base wall at the first end thereof, the first hub portion includes a second upstanding tab that extends outward from the first base wall at the second end thereof, the second hub portion includes a third upstanding tab that extends outward from the second base wall at the first end thereof, and the second hub portion includes a fourth upstanding tab that extends outward from the second base wall at the second end thereof, wherein each upstanding tab is engageable with a respective one of the first flexible pole, the second flexible pole, the third flexible pole, and the fourth flexible pole to limit a range of pivotal motion thereof.

8. The hub assembly of claim 1, wherein each opening of the first pair of aligned openings is in communication with a peripheral edge of the second hub portion.

9. The hub assembly of claim 1, wherein the base wall of the first hub portion is substantially aligned with the base wall of the second hub portion.

10. The hub assembly of claim 1, wherein the first hub portion is formed from a first stamped metal blank by one or more bending operations and the second hub portion is formed from a second stamped metal blank by one or more bending operations.

11. A hub assembly for collapsible structures, comprising:

a first hub portion having a substantially U-shaped configuration that is defined by a first base wall and a first pair of opposed side walls that extend outward from the first base wall, the first hub portion having a first end and a second end, wherein at least a first opening is defined by the first hub portion and is formed continuously through the first base wall and the first pair of opposed side walls of the first hub portion;

a second hub portion having a substantially U-shaped configuration that is defined by a second base wall and a second pair of opposed side walls that extend outward from the second base wall, the second hub portion having a first end and a second end, wherein at least a first pair of aligned openings is defined by the second hub portion, and the openings of the first pair of aligned openings are formed through the second pair of opposed side walls of the second hub portion, wherein the first hub portion and the second hub portion are connected in a crossing-configuration, such that at least part of the first hub portion is received within the first pair of aligned openings of the second hub portion and at least part of the second hub portion is received within the first opening of the first hub portion;

a first pivot joint located at the first end of the first hub portion, the first pivot joint including a first pin that is supported between the first pair of opposed side walls of the first hub portion and a first ferrule that is pivotally connected to the first pin;

a second pivot joint located at the second end of the first hub portion, the second pivot joint including a second pin that is supported between the first pair of opposed side walls of the first hub portion and a second ferrule that is pivotally connected to the second pin;

a third pivot joint located at the first end of the second hub portion, the third pivot joint including a third pin supported between the second pair of opposed side walls of the second hub portion and a third ferrule that is pivotally connected to the third pin; and a fourth pivot joint located at the second end of the second hub portion, the fourth pivot joint including a fourth pin supported between the second pair of opposed side walls of the second hub portion and a fourth ferrule that is pivotally connected to the fourth pin.

12. The hub assembly of claim 11, wherein the side walls of the first pair of opposed side walls are spaced apart from one another by a first internal channel, the side walls of the second pair of opposed side walls are spaced apart from one another by a second internal channel, the first pivot joint and the second pivot joint are each located at least partially within the first internal channel of the first hub portion, and the third pivot joint and the fourth pivot joint are each located at least partially within the second internal channel of the second hub portion.

13. The hub assembly of claim 11, wherein the first hub portion includes a first upstanding tab that extends outward from the first base wall at the first end thereof, the first hub portion includes a second upstanding tab that extends outward from the first base wall at the second end thereof, the second hub portion includes a third upstanding tab that extends outward from the second base wall at the first end thereof, and the second hub portion includes a fourth upstanding tab that extends outward from the second base wall at the second end thereof, wherein each upstanding tab is engageable with a respective one of the first ferrule, the second ferrule, the third ferrule and the fourth ferrule to limit a range of pivotal motion thereof.

14. The hub assembly of claim 11, further comprising:

a first flexible pole connected to the first ferrule of the first pivot joint for pivotal motion of the first flexible pole with respect to the first hub portion;

a second flexible pole connected to the second ferrule of the second pivot joint for pivotal motion of the second flexible pole with respect to the first hub portion;

a third flexible pole connected to the third ferrule of the third pivot joint for pivotal motion of the third flexible pole with respect to the second hub portion; and a fourth flexible pole connected to the fourth ferrule of the fourth pivot joint for pivotal motion of the fourth flexible pole with respect to the second hub portion.

15. The hub assembly of claim 14, wherein the first hub portion includes a first upstanding tab that extends outward from the first base wall at the first end thereof, the first hub portion includes a second upstanding tab that extends outward from the first base wall at the second end thereof, the second hub portion includes a third upstanding tab that extends outward from the second base wall at the first end thereof, and the second hub portion includes a fourth upstanding tab that extends outward from the second base wall at the second end thereof, wherein each upstanding tab is engageable with a respective one of the first flexible pole, the second flexible pole, the third flexible pole, and the fourth flexible pole to limit a range of pivotal motion thereof.

16. The hub assembly of claim 11, wherein each opening of the first pair of aligned openings is in communication with a peripheral edge of the second hub portion.

17. The hub assembly of claim 11, wherein the base wall of the first hub portion is substantially aligned with the base wall of the second hub portion.

18. A hub assembly for collapsible structures, comprising:

a first hub portion having a substantially U-shaped configuration that is formed by a first base wall and a pair of opposed side walls that extend outward from the first base wall, the first hub portion having a first end and a second end, the first hub portion having at least one opening formed in the first hub portion side walls;

a second hub portion having a substantially U-shaped configuration that is formed by a second base wall and a second pair of opposed side walls that extend outward from the second base wall, the second hub portion having a third end and a fourth end, and at least one opening formed therein and between the third and fourth ends, wherein at least part of the first hub portion is received within the opening of the second hub portion and at least part of the second hub portion is received with the opening of the first hub portion to connect the first hub portion to the second hub portion in a crossing configuration and wherein the first base wall is adjacent to the second base wall and the side walls of the first hub portion extend in the same outward direction as the side walls of the second hub portion;

a first flexible pole pivotally connected to the first hub portion first end by a first pin extending between the first hub portion side walls;

a second flexible pole pivotally connected to the first hub portion first end by a second pin extending between the first hub portion side walls;

a third flexible pole pivotally connected to the second hub portion first end by a third pin extending between the first hub portion side walls; and a fourth flexible pole pivotally connected to the second hub portion; and first end by a fourth pin extending between the first hub portion side walls.

19. The hub assembly of claim 18 wherein each of the first, second, third and fourth flexible poles are pivotally connected to the respective first and second hub portions by way of a respective ferrule.

* * * * *